US008554112B2

(12) United States Patent
Kidaka

(10) Patent No.: US 8,554,112 B2
(45) Date of Patent: Oct. 8, 2013

(54) CHARGING DEVICE

(75) Inventor: Hiroyuki Kidaka, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 180 days.

(21) Appl. No.: 13/035,396

(22) Filed: Feb. 25, 2011

(65) Prior Publication Data

US 2011/0222909 A1 Sep. 15, 2011

(30) Foreign Application Priority Data

Mar. 9, 2010 (JP) ..... 2010-052019

(51) Int. Cl.
*G03G 15/02* (2006.01)

(52) U.S. Cl.
USPC ..... 399/170; 399/168

(58) Field of Classification Search
USPC ..... 399/168, 170
See application file for complete search history.

(56) References Cited

U.S. PATENT DOCUMENTS

| | | | | |
|---|---|---|---|---|
| 5,504,560 | A * | 4/1996 | Kitagaki et al. | 399/168 |
| 7,146,123 | B2 | 12/2006 | Kidaka | |
| 7,599,642 | B2 | 10/2009 | Nakajima et al. | |
| 2008/0038011 | A1 | 2/2008 | Nakajima et al. | |
| 2009/0136253 | A1 * | 5/2009 | Nakajima et al. | 399/100 |
| 2010/0111554 | A1 * | 5/2010 | Kidaka | 399/66 |
| 2010/0158550 | A1 * | 6/2010 | Makino et al. | 399/45 |
| 2010/0158571 | A1 * | 6/2010 | Kidaka et al. | 399/170 |
| 2010/0322668 | A1 * | 12/2010 | Takishita | 399/170 |
| 2011/0286767 | A1 * | 11/2011 | Nakajima et al. | 399/170 |

FOREIGN PATENT DOCUMENTS

| | | | |
|---|---|---|---|
| JP | 60007447 | A * | 1/1985 |
| JP | 61221768 | A * | 10/1986 |
| JP | 2193158 | A | 7/1990 |
| JP | 10-020624 | A | 1/1998 |
| JP | 2004354639 | A * | 12/2004 |
| JP | 2007-072212 | A | 3/2007 |
| JP | 2008046297 | A | 2/2008 |
| JP | 2008-292768 | A | 12/2008 |

OTHER PUBLICATIONS

Notification of First Office Action in Chinese Patent Application No. 201110056158.7 dated May 30, 2013, State Intellectual Property Office of the People's Republic of China.

Notice of Allowance—Korean Patent Application No. 10-2011-0020397, Korean Patent Office, Jul. 11, 2013.

* cited by examiner

*Primary Examiner* — Walter L Lindsay, Jr.
*Assistant Examiner* — David Bolduc
(74) *Attorney, Agent, or Firm* — Fitzpatrick, Cella, Harper & Scinto

(57) ABSTRACT

A charging device includes a corona charger; a shutter of a sheet for shielding an opening of said corona charger, the sheet having such a property that it is curled about an axis when said shutter absorbs moisture; and a winding-up device for winding up the shutter. The axis and a winding-up direction in which the shutter is wound up by the winding-up means form an angle therebetween from 45 degrees to 135 degrees.

8 Claims, 7 Drawing Sheets

(A)

(B)

CHARGING DEVICE

FIELD OF THE INVENTION AND RELATED ART

The present invention relates to a charging device used in an image forming apparatus, such as a copying machine, a printer or a facsimile machine.

In an image forming apparatus of an electrophotographic type, an image has been conventionally formed through an electrophotographic process including steps of charging, exposure, development and transfer. Of these steps, in the charging step a photosensitive member has been electrically charged uniformly to a potential of a predetermined polarity by a corona charger provided closely to the photosensitive member. In the charging step using the corona charger, corona discharge is utilized, so that an electric discharge product such as ozone ($O_3$) or nitrogen oxides ($NO_x$) is generated. When such an electric discharge product is deposited on the photosensitive member and takes up moisture, a so-called "image deletion (flow)" phenomenon such that a surface resistance at a portion on which the electric discharge product is deposited is lowered and thus an electrostatic latent image depending on image information cannot be faithfully formed is caused.

As one of means for solving the problem, a means for preventing deposition of the electric discharge product on the photosensitive member during non-image formation by providing a shutter to the corona charger so as to cover an opening of the corona charger has been known. Specifically, Japanese Laid-Open Patent Application (JP-A) 2008-046297 has proposed opening and closing movement of the shutter along a longitudinal direction of the corona charger.

The corona charger is disposed closely to the photosensitive member surface and therefore there is a need to provide the shutter in a narrow gap. In such a constitution, there is a possibility that the shutter is contacted to a photosensitive drum when the shutter is moved for being opened and closed.

As a result of study on such a problem by the present inventor, it was found that deterioration (occurrence of damage or the like) of the photosensitive member when the shutter is contacted to the photosensitive member can be suppressed by using a sheet-like shutter of a nonwoven fabric, a woven fabric, a knitted fabric or the like.

However, the sheet containing fiber is liable to be deformed by a change in environment (particularly moisture absorption in a high temperature and high humidity environment). Specifically, the nonwoven fabric has a tendency to be curled generally with respect to a direction (flow) of the fiber of the nonwoven fabric as an axis when the nonwoven fabric is left standing for a long time in the high temperature and high humidity environment. Similarly, the woven fabric and the knitted fabric have a tendency to be curled with respect to a direction, as an axis, in which a density of a weave texture (a space between threads of the fabric) is low (coarse).

For this reasons, the shape of the shutter was changed depending on an operation environment (particularly the humidity), so that there was a problem that the opening of the corona charger was unable to be properly covered with the shutter.

SUMMARY OF THE INVENTION

A principal object of the present invention is to provide a charging device capable of properly covering an opening of a corona charger even when a shutter absorbs moisture.

According to an aspect of the present invention is to provide a charging device comprising:

a corona charger;

a shutter of a sheet for shielding an opening of the corona charger, the sheet having such a property that it is curled about an axis when the shutter absorbs moisture; and winding-up means for winding up the shutter, wherein the axis and a winding-up direction in which the shutter is wound up by the winding-up means form an angle therebetween from 45 degrees to 135 degrees.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

Part (A) of FIG. 1 is a schematic perspective view showing a state in which an axis of curl of a charged shutter and a winding-up direction of a winding-up device are perpendicular to each other, and (B) is a schematic perspective view showing a state of curl of the charging shutter about the axis of curl.

Figure 3:
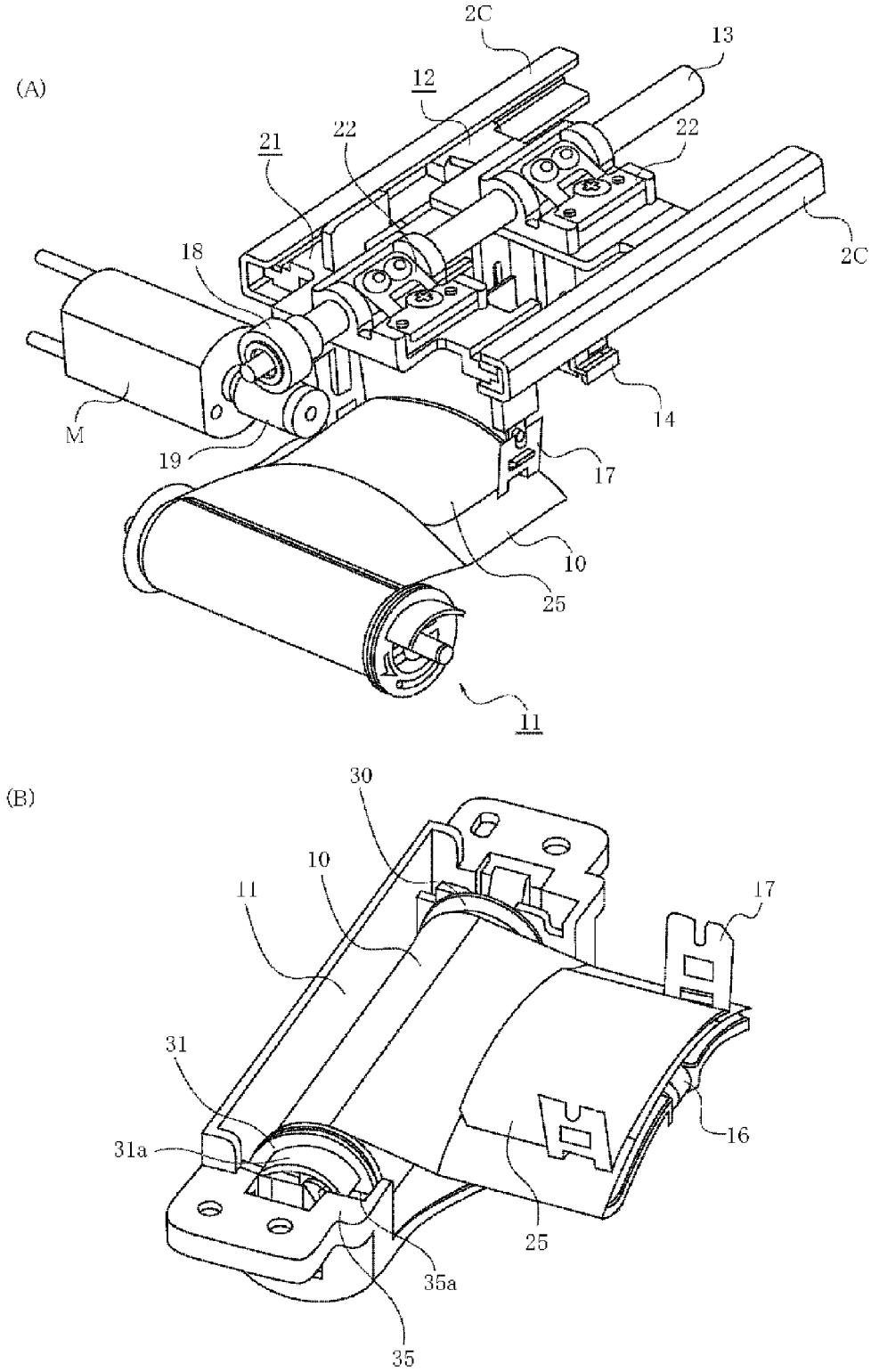

Parts (A) and (B) of FIG. 3 are schematic perspective view showing an opening and closing mechanism for the charger shutter.

Figure 4:
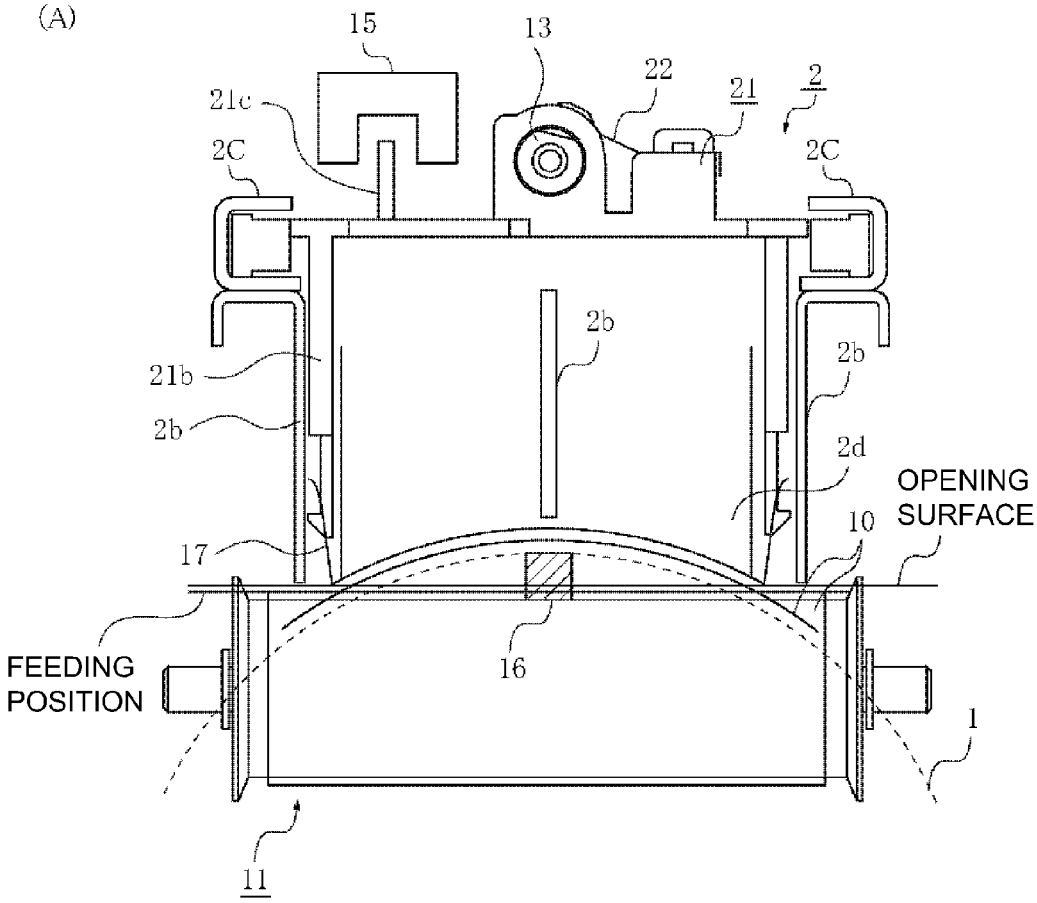
Figure 4:
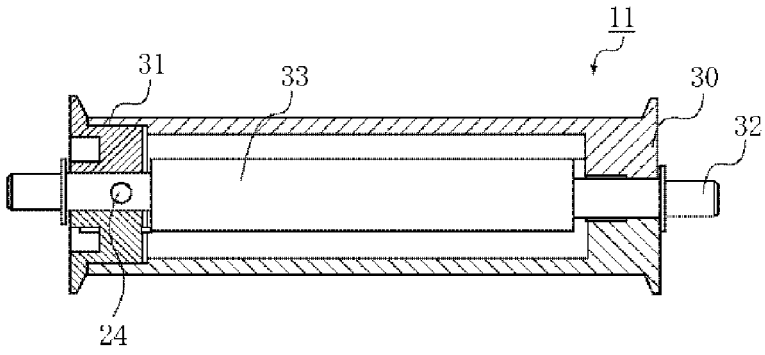

Part (A) of FIG. 4 is a schematic side view of a charger, and (B) is a schematic sectional view of the winding-up device.

Figure 5:
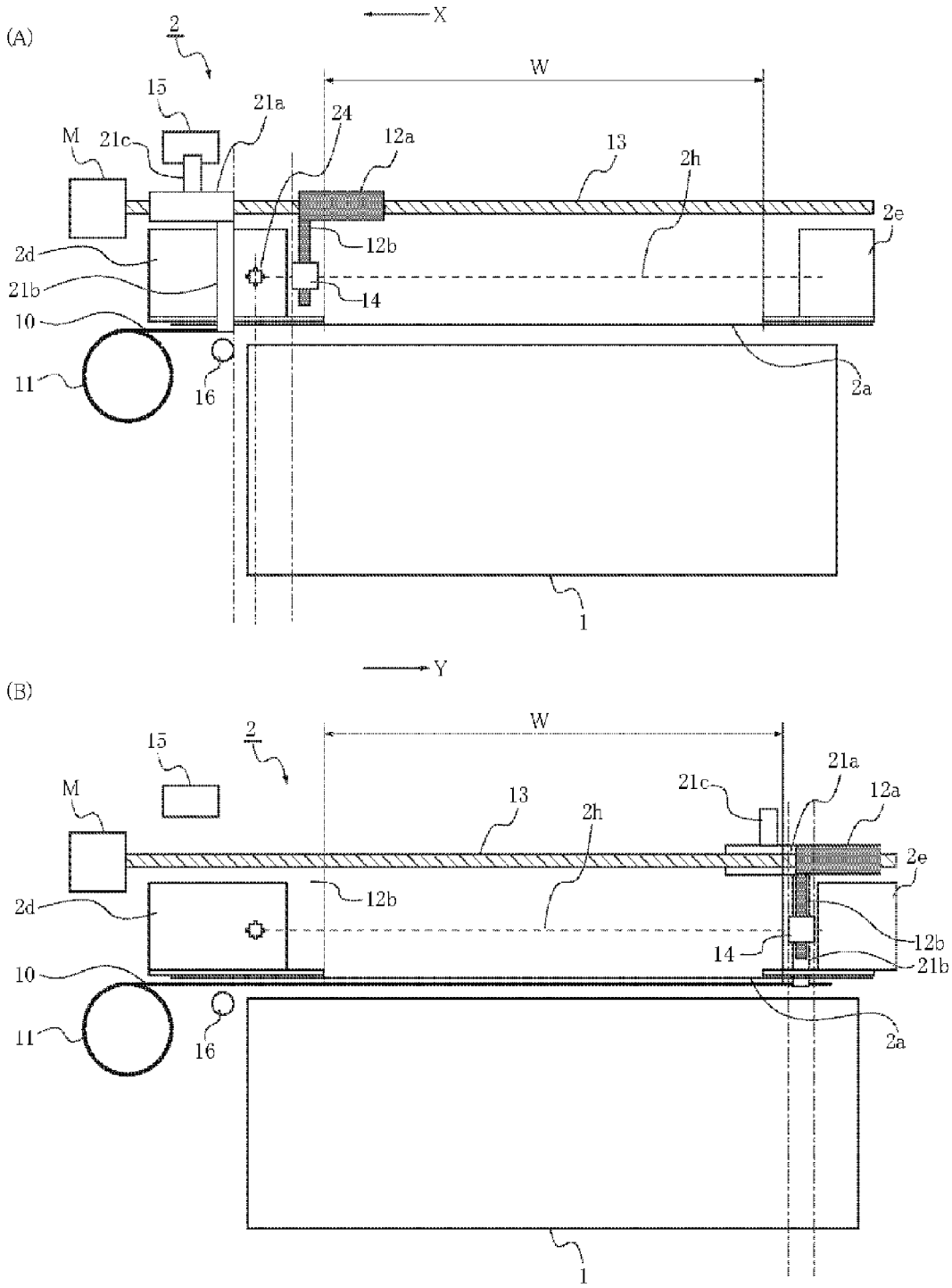

Part (A) of FIG. 5 is a schematic view showing a state in which the charging shutter is opened, and (B) is a schematic view showing a state in which the charging shutter is closed.

Figure 6:
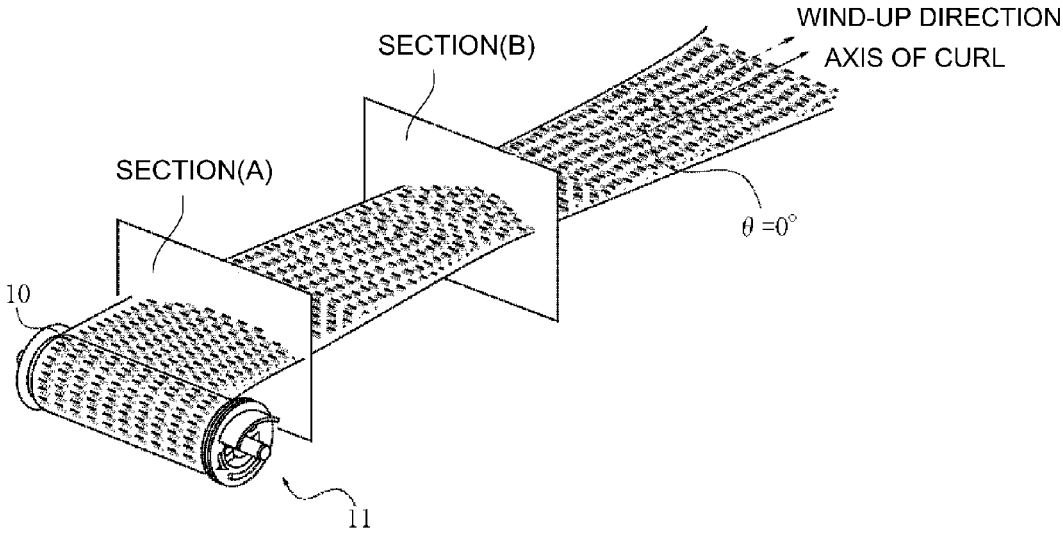
Figure 6:
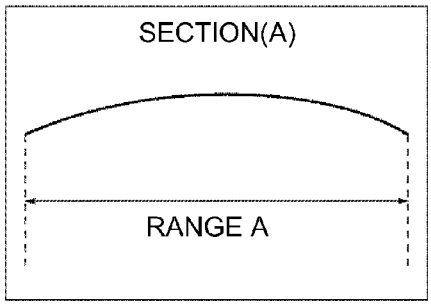
Figure 6:
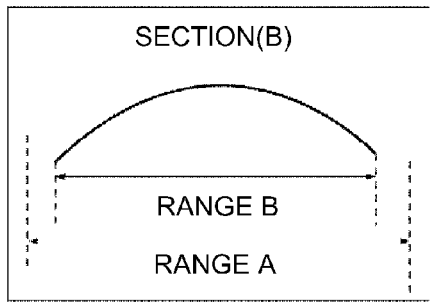

FIG. 6 includes schematic views showing a state in which the axis of curl of the charging shutter coincides with the winding-up direction of the winding-up device.

Figure 7:
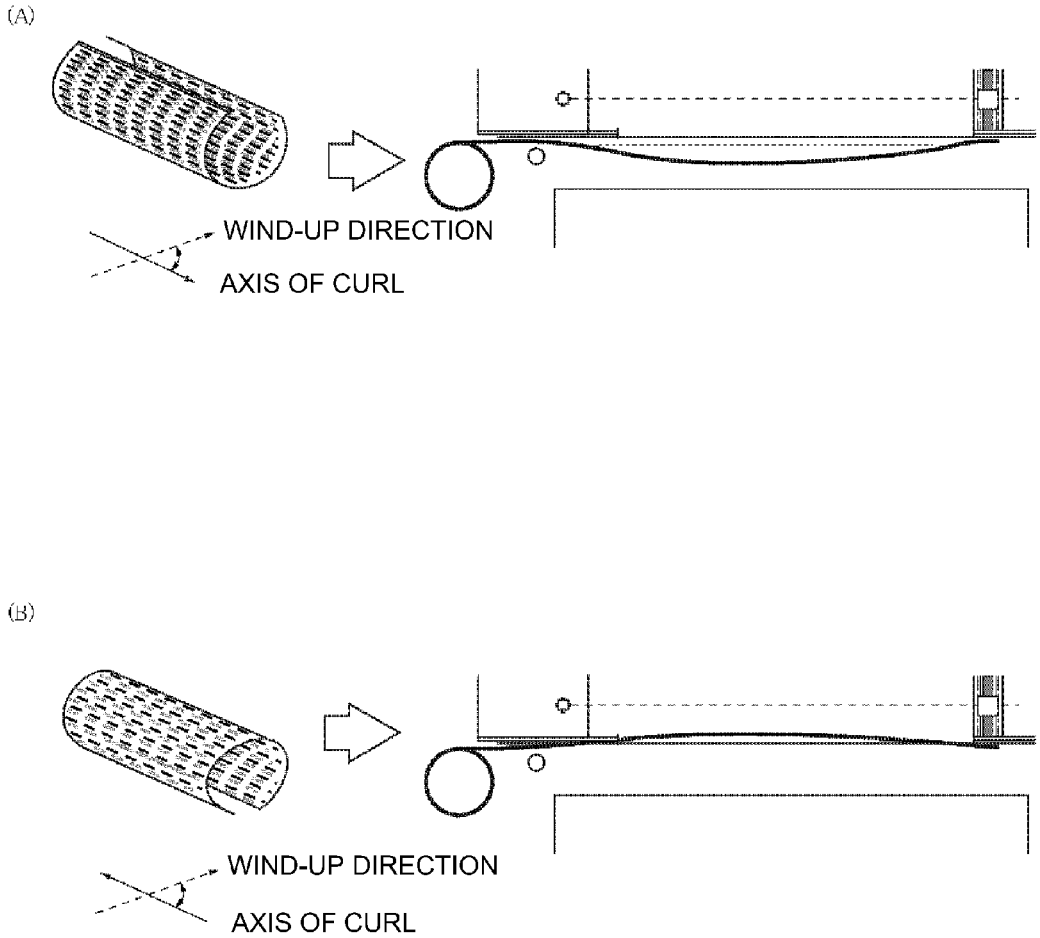

Parts (A) and (B) of FIG. 7 are schematic views for illustrating a front surface and a rear surface of the charging shutter.

DETAILED DESCRIPTION OF THE PREFERRED EMBODIMENTS

Hereinbelow, embodiments according to the present invention will be described with reference to the drawings. Incidentally, in the respective drawings, members or means indicated by identical reference numerals or symbols have the same constitutions or functions, thus being appropriately omitted from redundant explanation.

[Embodiment 1]

First, a general structure of an image forming apparatus will be described with reference to FIG. 2. Therefore, a charging device will be described in detail. The image forming apparatus in this embodiment is a laser beam printer of an electrophotographic type.

1. General Structure of Image Forming Apparatus)

Figure 2:
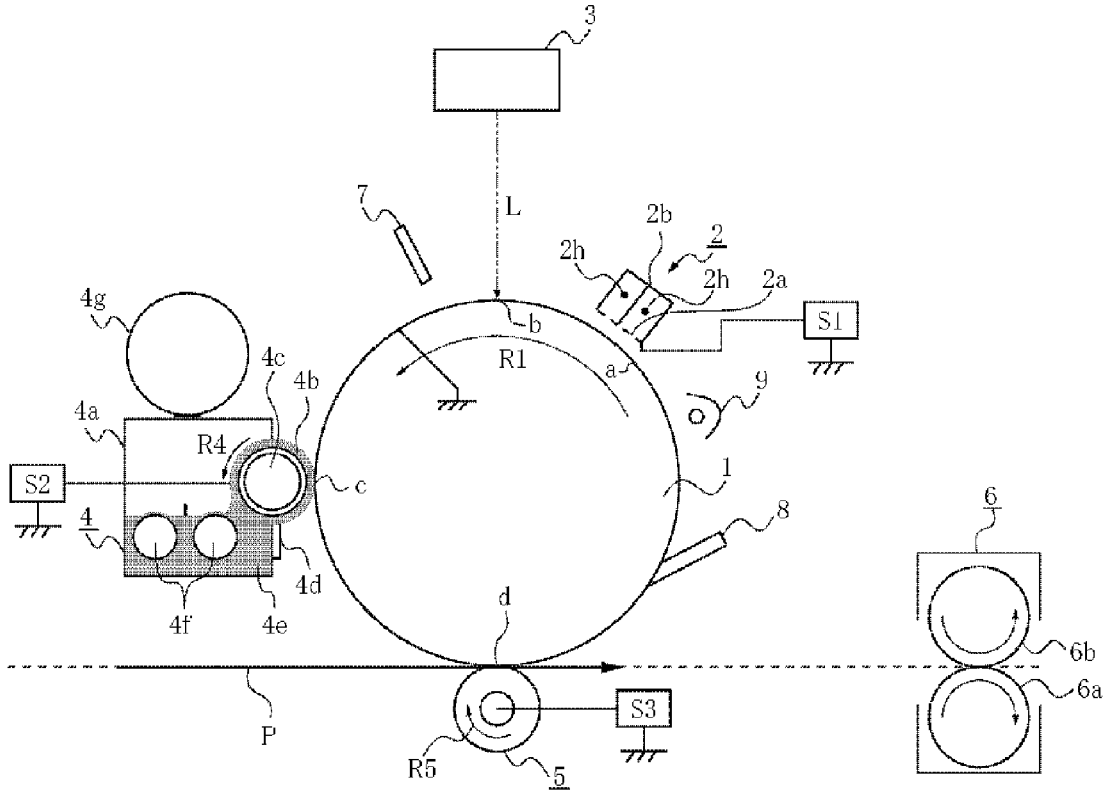
FIG. 2 is a sectional view for illustrating a schematic structure of an image forming apparatus.

As shown in FIG. 2, a charging device 2, an exposure device 3, a potential measuring device 7, a developing device 4, a transferring device 5, a cleaning device 8, and an optical discharging device 9 are provided in this order around a photosensitive member (image bearing member) 1 along a rotational direction (indicated by an arrow R1) of the photosensitive member 1. Further, a fixing device 6 is provided downstream of the transferring device 5 with respect to a conveyance direction of a recording material P.

Next, individual image forming devices associated with image formation will be described specifically.

(Photosensitive Member)

As shown in FIG. 2, the photosensitive member 1 in this embodiment as the image bearing member is a cylindrical (drum-type) electrophotographic photosensitive member having a photosensitive layer of a negatively chargeable organic optical semiconductor. The photosensitive member 1 of the drum type has a diameter of 84 mm and a longitudinal length of 380 mm. Further, the photosensitive member 1 is rotationally driven in the arrow R1 direction about a center shaft (not shown) at a process speed (peripheral speed) of 500 mm/sec.

(Charging Device)

The charging device 2 in this embodiment is, as shown in FIG. 2, a corona charger of a scorotron type including a discharging wire 2*h*, a U-shaped electroconductive shield 2*b* which is provided so as to surround the discharging wire, and a grid electrode 2*a* provided at an opening of the shield 2*b*. In this embodiment, in order to meet high-speed image formation, the corona charger 2 including two discharging wires 2*h* and a partition wall provided between the two discharging wires 2*h* is used. The corona charger 2 is provided along a generatrix direction of the photosensitive member 1. Therefore, a longitudinal direction of the corona charger 2 is parallel to an axial (shaft) direction of the photosensitive member 1. Further, as shown in (A) of FIG. 4, the grid electrode 2*a* is disposed along the circumferential surface of the photosensitive member so that a central portion thereof with respect to a widthwise (short) direction (a photosensitive member movement direction) is separated from the photosensitive member in a larger distance than that at both end portions thereof. As a result, compared with the conventional image forming apparatus, the corona charger 2 can be brought nearer to the photosensitive member 1, so that a charging efficiency can be improved.

Further, to the corona charger 2, a charging bias application source S1 for applying a charging bias is connected, so that the corona charger 2 has the function of uniformly charging the surface of the photosensitive member 1 to a potential of a negative polarity at a charging position a by the charging bias applied from the application source S1. Specifically, the charging bias of a DC voltage is applied to the discharging wires 2*h* and the grid electrode 2*a*.

Further, the corona charger 2 in this embodiment is provided with a charging shutter for preventing the electric discharge product from being deposited on the photosensitive member 1. A structure of this charging shutter will be described layer in detail.

(Other Image Forming Portions)

Image forming devices (image forming portions) relating to image forming steps such as exposure, development and transfer will be briefly described below.

The exposure device 3 in this embodiment is a laser beam scanner including a semiconductor laser for irradiating the photosensitive member 1 charged by the corona charger 2 with laser light L. Specifically, on the basis of an image signal (information) sent from a host computer connected to the image forming apparatus through a network cable, the image exposure device 3 outputs the laser light L. The charged surface of the photosensitive member 1 is exposed to the laser light L along a main scan direction at an exposure position b. By repeating the exposure along the main scan direction during the rotation of the photosensitive member 1, of the charged surface of the photosensitive member 1, a portion irradiated with the laser light L is lowered in potential, so that an electrostatic latent image is formed correspondingly to the image information.

Here, the main scan direction means a direction parallel to the generatrix of the photosensitive member 1 and a sub-scan direction means a direction parallel to the rotational direction of the photosensitive member 1.

The developing device 4 deposits a developer (toner) on the electrostatic latent image formed on the photosensitive member 1 by the charging device 2 and the exposure device 3 to visualize the latent image. The developing device in this embodiment employs a two component magnetic brush developing method and also employs a reverse developing method.

To the developing sleeve 4*b*, a developing bias application source S2 is connected, and the toner in the developer carried on the surface of the developing sleeve 4*b* is selectively deposited correspondingly to the electrostatic latent image on the photosensitive member 1 by an electric field generated by a developing bias applied from the application source S2. As a result, the electrostatic latent image is developed as the toner image. In this embodiment, the toner is deposited at an exposed portion (laser light irradiation portion) on the photosensitive member 1, so that the electrostatic latent image is reversely developed.

The transfer device 5 in this embodiment includes a transfer roller 5 as shown in FIG. 2. The transfer roller 5 is urged against the surface of the photosensitive member 1 with a predetermined urging force to form a nip therebetween as a transfer portion d. To the transfer portion d, the recording material P (e.g., paper or a transparent film) is sent from a sheet-feeding cassette with predetermined control timing.

The recording material P sent to the transfer d is subjected to transfer of the toner image formed on the photosensitive member 1 while being nip-conveyed between the photosensitive member 1 and the transfer roller 5. At this time, to the transfer roller 5, a transfer bias (+2 KV in this embodiment) of an opposite polarity to the normal charge polarity (negative) of the toner is applied from a transfer bias application source S3.

The fixing device 6 in this embodiment includes a fixing roller 6*a* and a pressing roller 6*b* as shown in FIG. 2. The recording material P on which the toner image is transferred by the transfer device 5 is conveyed to the fixing device in which the toner image is heated and pressed between the fixing roller 6*a* and the pressing roller 6*b* to be fixed on the recording material P. The recording material P subjected to the fixing is then discharged to the outside of the image forming apparatus.

The cleaning device 8 in this embodiment includes, as shown in FIG. 2, a cleaning blade. After the toner image is transferred on the recording material P by the transfer device 5, untransferred toner remaining on the photosensitive member 1 surface is removed by the cleaning blade.

The optical discharging device 9 in this embodiment includes, as shown in FIG. 2, a discharging exposure lamp. Residual charges remaining on the surface of the photosensitive member 1 subjected to the cleaning by the cleaning device 8 are removed by light irradiation by the discharging exposure lamp 9.

A series of the image forming processes by the image forming devices described above is completed and the image forming apparatus prepares for a subsequent image forming operation.

2. Detail Structure of Charging Device

The structure of the charging device will be described in detail below.

(Charger Shutter)

First, a charger shutter 10 as a sheet-like member for covering and uncovering the opening of the corona charger 2 will be described. The opening of the corona charger 2 refers to the opening formed with respect to the shield and corresponds to a charging region (W in FIG. 5) of the corona charger 2. Therefore, the charging region W of the corona charger 2 substantially coincides with a region in which the photosensitive member 1 is electrically chargeable.

In this embodiment, as shown in (A) of FIG. 3, a non-endless sheet-like shutter capable of being wound up in a roll shape by a winding-up device 11 is employed as the charger shutter 10 for covering and uncovering the opening of the corona charger 2. As a result, it is possible to prevent the deposition of the electric discharge product on the photosensitive member by the shutter and to reduce a space by retraction of the shutter in the roll shape during the image forming operation. Further, by using a soft nonwoven fabric, even when the photosensitive member and the shutter are contacted to each other, deterioration (damage or the like) of the photosensitive member can be suppressed.

In this embodiment, as the charging shutter 10, a sheet-like shutter formed of the nonwoven fabric by rayon fiber in a thickness of 150 μm is employed. Incidentally, the nonwoven fabric containing polyester fiber may also be used. Further, at a leading end portion of the shutter with respect to an opening covering direction (closing direction), a resin sheet (PET film) of 50 μm in thickness is provided as a protective sheet 25 having an abrasion resistance higher than that of the nonwoven fabric. As a result, durability of the shutter can be enhanced. Incidentally, the protective sheet 25 is not limited to the resin sheet so long as the protective sheet 25 is formed of a material which is resistive to rubbing (abrasion) move than the nonwoven fabric used for the charging shutter. Specifically, the protective sheet 25 may only be required to possess the abrasion resistance higher than that of the charging shutter 10 in a Gakushin-type friction test using a friction (rubbing) tester defined in JIS L-0849.

(Charging Shutter Driving Mechanism)

Parts (A) and (B) of FIG. 5 show an open state and a closed state, respectively, of the charging shutter 10. Part (A) of FIG. 3 is a perspective view showing a detail structure of an opening and closing mechanism of the charging shutter, and (B) of FIG. 3 is a perspective view for illustrating a detail structure of a winding-up device. Further, (A) of FIG. 4 is a sectional view of the corona charger as seen from a longitudinal one end side of the corona charger, and (B) of FIG. 4 is a sectional view of the winding-up device. A mechanism (opening and closing mechanism for moving the charging shutter in an opening (uncovering) and closing (covering) direction will be described below.

The opening and closing mechanism of the charging shutter 10 includes a driving motor M, a winding-up device 11, a first movable member 21 for holding the charging shutter 10, a second movable member 12 for holding a cleaning member 14, and a rotatable member 13. By these members, the charger shutter 10 can be moved for being opened and closed along the longitudinal direction (the main scan direction) of the charger shutter 10.

Further, as shown in (A) of FIG. 3, (A) of FIG. 4 and FIG. 5, a shutter detecting device 15 for detecting completion of an opening operation of the charger shutter 10 is provided. The shutter detecting device 15 includes a photo-interrupter. When the first movable member (carriage) 21 reaches the opening operation completion position, the opening operation completion of the charger shutter 10 is detected by utilizing light-blocking of the photo-interrupter 15 by a light-blocking member 21*c*. That is, at the time when the photointerrupter 15 detects the light-blocking member 21*c* of the first movable member 21, the rotation of the driving motor M is stopped.

As shown in (A) of FIG. 3, on a leading end side of the charging shutter 10 with respect to a closing direction of the charging shutter 10, a shutter fixing member 17 (leaf spring) functioning as a regulating means for regulating the shape of the charging shutter is provided so that a short direction central portion of the charging shutter is protruded toward the corona charger side more than short direction both end portions of the charging shutter. The shutter fixing member 17 is locked and fixed to a connecting member 21*b* provided integrally with the first movable member 21. The first movable member 21 and the second movable member (carriage) 12 include a drive transmission member 22 provided threadably mounted on the rotatable member 13 and is driving-connected with the rotatable member 13 through the drive transmission member 22. Further, the first movable member 21 and the second movable member 12 are threadably mounted so as to be movable only in the main scan direction on a rail 2*c* provided on the corona charger 2, thus being prevented from rotating together with the rotatable member 13.

To the rotatable member 13, a spiral groove is provided and a gear 18 is connected at one end of the rotatable member 13. On the other hand, to an end of the driving motor M, a warm gear 19 is connected and transmits a driving force of the driving motor M to the rotatable member 13 through an engaging portion between the warm gear 19 and the gear 18.

When the rotatable member 13 is rotationally driven by the driving motor M, the first movable member and the second movable member 12 are moved in the main scan direction (X or Y direction) along the spiral groove. Therefore, when the rotatable member 13 is driven by the driving motor M, through the connecting member 21*b* formed integrally with the first movable member 21, a moving force in the opening and closing direction is transmitted to the charger shutter 10.

Further, the second movable member 12 is integrally provided with a connecting member 12*b* for holding a cleaning member 14 for cleaning the discharging wires 2*h*.

Therefore, simultaneously with the movement of the charging shutter 10 in the main scan direction (X or Y direction) by the driving motor M as described above, the cleaning member 14 is also moved in the same direction.

As a result, it becomes possible to drive the discharging wires 2*h* and the charging shutter 10 by the same driving motor M.

Part (A) of FIG. 5 shows a state in which the charging shutter 10 is opened by winding up the charging shutter 10 as the sheet-like member so that the charging shutter 10 is moved in the X direction (opening direction). Part (B) of FIG. 5 shows a state in which the charging shutter 10 is closed by pulling the charging shutter 10 as the sheet-like member so that the charging shutter 10 is moved in the Y direction (closing direction).

(Charger Shutter Winding-Up Mechanism)

Next, the winding-up mechanism for the charging shutter 10 will be described. Part (B) of FIG. 4 is a sectional view showing a constitution of the winding-up device 11 as the winding-up means.

The winding-up device 11 includes a cylindrical winding-up roller (winding-up member) 30 for fixing one end of the charging shutter 10 and for winding up the charging shutter 10, a shaft member 32 for shaft-supporting one end of the winding-up roller 30, and a shaft-supporting member 31 for shaft-supporting the other end of the winding-up roller 30. Further, the winding-up device 11 includes a parallel pin 34 which is a fixing member for fixing the shaft-supporting member 31 and the shaft member 32 and includes a spring (urging member) 33 provided in the winding-up roller 30 and engaged with the winding-up roller 30 and the shaft-supporting member 31.

The shaft-supporting member 31 and the shaft member 32 are fixed in a non-rotatable manner, so that only the winding-uproller 30 is shaft-supported in a rotatable manner.

Further, in order to prevent slack of the charging shutter 10 when the charging shutter 10 is moved in the opening direction, there is a need to apply a winding-up force, causing no slack, to the winding-up device 11 in advance. Specifically, when the charging shutter 10 is pulled in its closing direction, the shaft-supporting member 31 is mounted so that a torsional force of the spring 33 as the urging member is exerted in a direction in which the winding-up roller 30 winds up the charging shutter 10.

Therefore, when the charger shutter 10 is opened ((A) of FIG. 5), in interrelation with the movement of the charger shutter 10 in the X direction by the driving motor M, the winding-up roller 30 winds up the charger shutter 10 as needed with no downward slack of the charger shutter 10.

On the other hand, when the charger shutter 10 is closed ((B) of FIG. 5), the driving motor M pulls the charger shutter 10 from the winding-up roller 30 against the urging force of the spring 33 in the winding-up roller 30, so that the charger shutter 10 is moved in the Y direction.

Incidentally, when the charger shutter 10 is in a state in which the charging shutter 10 covers the entire region of the opening, the urging force toward the X direction by the spring 33 in the winding-up roller 30 is exerted on the charger shutter 10, so that the charging shutter 10 does not slack down.

Therefore, when the charging shutter 10 is closed, a constitution in which the gap is not readily created between the charging shutter 10 and the corona charger 2 is employed, so that it becomes possible to keep a state in which the corona product is less liable to be leaked to the outside.

(Curvature Shape Imparting Mechanism for Charging Shutter)

In this embodiment, the corona charger 2 is, as described above, provided so that the central portion of the grid electrode 2*a* with respect to the short direction of the grid electrode 2*a* (the circumferential direction of the photosensitive member) is separated from the photosensitive member 1 along the circumferential surface of the photosensitive member 1 in a distance longer than that at the both end portions of the grid electrode 2*a*. For this purpose, in this embodiment, a curvature shape imparting mechanism as the regulating means is provided so that the shape of the charging shutter 10 also follow (corresponds to) the shape of curvature of the circumferential surface of the photosensitive member 1. In this embodiment, as the curvature shape imparting mechanism, the curvature shape imparting mechanism for the leading end of the charging shutter 10 and the curvature shape imparting mechanism for the charging shutter 10 on the winding-up port side are provided and will be described below in this order.

First, the curvature shape imparting mechanism for the leading end of the charging shutter 10 will be described. Part (A) of FIG. 4 is a sectional view of the corona charger as seen from its short direction.

As shown in FIGS. 3 and 4, on one longitudinal end side of the charging shutter 10 located out of a winding-up range of the winding-up device 11, the shutter fixing member 17 for fixing the charging shutter 10 to the movable member 12 is attached.

This shutter fixing member 17 is constituted by a member having elasticity so as to follow the shape of curvature of the circumferential surface of the photosensitive member 1 when the shutter fixing member 17 is attached to the connecting member 21*b*.

In this embodiment, as shown in FIGS. 3, 4 and 5, a rotatable member, i.e., a so-called roller which is guiding member 16 is provided, as a second curvature shape imparting mechanism, for the charging shutter 10 on the winding-up port side of the winding-up device 11.

The guiding member 16 is different from the shutter fixing member 17 and has a structure such that it guides the charging shutter 10 while being rotated by the opening and closing movement of the charging shutter 10. Therefore, the guiding member 16 can prevent an increase in load required for the opening and closing movement of the charging shutter 10 when the guiding member 16 regulates the shape of the charging shutter 10 so that as to be a desired shape of curvature. Further, the guiding member 16 is disposed at a position which is out of a winding-up range of the winding-up device 11 and is closer to the winding-up device 11 than the photosensitive member 1.

Further, an uppermost portion of the roller as the guiding member 16 is located closer to the corona charger 2 than the closest position (the outer circumferential surface) of the photosensitive member 1 with respect to the corona charger 2, so that the charging shutter 10 forms a sliding relation with the guiding member 16 during the opening and closing operation.

Further, the guiding member 16 also has the function as a shutter insertion guide for guiding the charging shutter 10 to the small gap (spacing) between the grid electrode 2*a* and the photosensitive member 1.

Therefore, also on the side where the charging shutter 10 is wound up by the winding-up device 11, it is possible to keep such a shape that the short direction central portion of the charging shutter 10 is protruded toward the corona charger 2 side more than the short direction both end portions of the charging shutter 10.

3. Winding-Up Direction of Shutter

Next, the winding-up direction of the charging shutter 10 will be described. The sheet-like charging shutter 10 as a shielding member (shutter) has a tendency to be curled in the high humidity environment. In this embodiment, the winding-up of the charging shutter is characterized by an angle formed between an axial direction of the curl and the winding-up direction (shutter pulling-out direction).

(Charging Shutter Winding-Up Direction)

Figure 1:
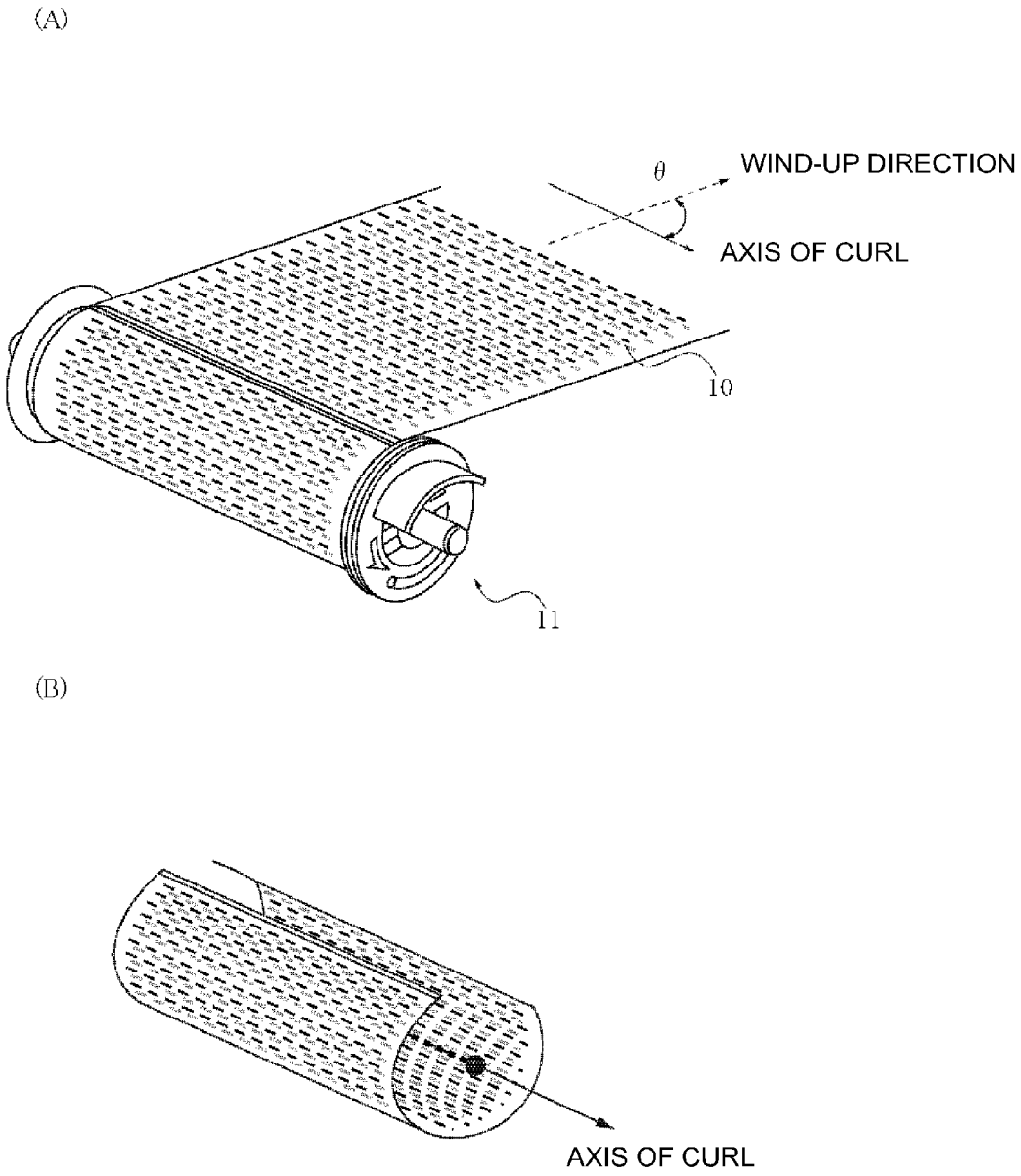

The winding-up direction of the charging shutter 10 will be described below. Part (A) of FIG. 1 shows the winding-up direction of the charging shutter 10 about the winding-up device in this embodiment.

In this embodiment, as described above, as the charging shutter 10, the 150 μm-thick sheet-like nonwoven fabric of rayon fiber is employed. This rayon nonwoven fabric has been subjected to water jet (hydraulic entangling) processing and has a directionality (flow) of orientation of the constituent rayon fiber. Part (B) of FIG. 1 illustrates swelling and deformation of the fiber due to moisture absorption when the rayon nonwoven fabric is left standing for 2 hours in an environment of a temperature of 50° C. and a humidity of 80%. Herein, the deformation of the fiber means a so-called curl with an axis such that the fiber is curled generally along the direction (flow) of the fiber. Incidentally, in this embodiment, the nonwoven fabric containing the rayon fiber is evaluated but a similar result is obtained also with respect to the fabric of polyester fiber or the like.

In this embodiment, as shown in (A) of FIG. 1, an angle θ formed between the winding-up direction of the charging shutter 10 about the winding-up device 11 (a broken line in (A) of FIG. 1) and the axial direction of curl of the charging shutter 10 in the environment described above (hereinafter referred to as a winding-up angle θ) was constituted to be 90 degrees (intersection at right angles). By this constitution, the curl of the charging shutter 10 in the high humidity environment is eliminated by the urging force of the spring 33 as the urging member in the winding-up roller 30 in the longitudinal direction as shown in FIG. 6. As a result, downward stack (or upward protrusion) of the charging shutter 10 is suppressed. Further, when the winding-up direction and the axial direction of curl intersect at substantially right angles, i.e., when the winding-up angle θ is about 90 degrees±5 degrees, the charging shutter 10 can cover the opening of the corona charger most satisfactorily. Further, the winding-up angle θ is within the range from 45 degrees to 135 degrees, the above problem can be alleviated (Table 1). When the winding-up angle θ is within the range from 60 degrees to 120 degrees, the charging shutter 10 can more suitably cover the opening.

On the other hand, the case where the winding-up angle θ is out of the range from 45 degrees to 135 degrees will be described with reference to FIG. 6. FIG. 6 shows the shape of the charging shutter 10 in the closed state in the case where the opening and closing operation is performed for a long term in the high humidity environment when the winding-up angle θ is 0 degrees (or 180 degrees) which is most unsuitable.

In this embodiment, as described above, as the curvature shape imparting mechanism, the curvature shape imparting mechanism for the leading end of the charging shutter 10 and the curvature shape imparting mechanism for the charging shutter 10 on the winding-up port side are provided. Therefore, as shown at cross-section (A), both end portions of the charging shutter 10 can properly cover the opening W of the corona charger while retaining a shielding (covering) range A by the effect of these curvature shape imparting mechanisms. However, in the neighborhood of the central portion of the charging shutter 10, there is no means for suppressing the curl. Therefore, as shown by a shielding range B at cross-section (B), the shielding range of the charging shutter 10 is decreased. As a result, the gap generated due to the curl was liable to be formed between the charging shutter 10 and the corona charger 2, thus resulting in a state in which the corona product was liable to be leaked to the outside.

Table 1 is a table showing an evaluation result of a shielding area of the opening of the corona charger in the case where the nonwoven fabric of the rayon fiber is left standing for 2 hours in the high humidity environment (temperature: 50° C., humidity: 80%). In the case where the shielding area in a low humidity environment (temperature: 23° C., humidity: 5%) is 100%, as described above, the electric discharge product is shielded in an area exceeding 97% in the range from 45 degrees to 135 degrees, thus being shielded satisfactorily. Further, in the range from 60 degrees to 120 degrees, the area exceeding 99% is shielded.

TABLE 1

| θ (DEG.) | 0 | 30 | 45 | 60 | 90 | 120 | 135 | 150 | 180 |
|---|---|---|---|---|---|---|---|---|---|
| Evaluation | x | Δ | ○ | ◎ | ◎ | ◎ | ○ | Δ | x |

The evaluation was made by a decrease (%) in shielding area due to the curl in the high humidity environment when the shielding area in the low humidity environment was 100%.

◎: about 0.01% or more and below 1%
○: 1% or more and below 3%
Δ: 3% or more and below 5%
x: 5% or more As described above, by placing the winding-up angle θ in the range from 45 degrees to 135 degrees, even in the high humidity environment in which the change in shape of the shutter was liable to occur, the opening of the corona charger was able to be properly covered for a long term. As a result, it was possible to decrease or prevent the degree of the occurrence of the image flow phenomenon.

Further, in this embodiment, the nonwoven fabric of the rayon fiber is described as an example of the material for the charging shutter 10 but the present invention is also applicable to materials other than the nonwoven fabric so long as the materials cause the curl of the charging shutter material in the high humidity environment.

Further, as shown in FIG. 7, the charging shutter has a front surface and a back surface. That is, the sheet placed on a flat surface becomes concave or convex depending on the type of the surfaces of the sheet (charging shutter). For that reason, in the constitution in which the axis of the curl of the charging shutter and the longitudinal direction of the corona charger intersect at substantially right angles, the following problem arises when the type (front/back) of the surfaces of the sheet is not taken into consideration. That is, when the charging shutter is curled by moisture absorption so as to be convex toward the photosensitive member, a possibility of friction of the charging shutter with the photosensitive member becomes high ((A) of FIG. 7). For that reason, the type of the surfaces of the sheet may preferably be considered so that the longitudinal central portion of the charging shutter is convex toward the discharging wires when the charging shutter is curled by the moisture absorption ((B) of FIG. 7). By employing such a constitution, even when the charging shutter is deformed (curled) by the moisture absorption, the contact of the charging shutter with the photosensitive member can be suppressed. That is, by taking the type of surfaces of the charging shutter into consideration, it is possible to suppress the contact of the charging shutter with the photosensitive member while covering the opening so that the electric discharge product cannot be deposited on the photosensitive member. Incidentally, in this embodiment, the charging shutter is urged by the winding-up device, in the direction in which the curl is suppressed, while being urged by the leaf spring. For that reason, even in the case where the charging shutter is deformed (curled) by the moisture absorption the charging shutter is configured to less slide on the photosensitive member or the grid electrode.

Incidentally, in the above-described embodiments, the case where the corona charger is used for substantially uniformly charging the photosensitive member in a pre-step for forming the electrostatic image on the photosensitive member is described but the present invention is not limited thereto. For example, the present invention is similarly applicable to the case where the corona charger is used for electrically charging the toner image formed on the photosensitive member.

Further, in the above-described embodiments, the case where the grid electrode is provided at the opening of the corona charger is described but the present invention is similarly applicable to also the case where the grid electrode is not provided to the corona charger.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 052019/2010 filed Mar. 9, 2010, which is hereby incorporated by reference.

What is claimed is:

1. A charging device comprising:

a corona charger;

a shutter comprising a sheet for shielding an opening of said corona charger, said sheet having such a property that it is curled about an axis when said sheet absorbs moisture; and a winding-up device configured to wind up said shutter, wherein the axis and a winding-up direction in which said shutter is wound up by said winding-up device form an angle therebetween from 45 degrees to 135 degrees.

2. A charging device according to claim 1, wherein said winding-up device winds up said shutter with respect to a longitudinal direction of said corona charger and urges said shutter in the winding-up direction of said shutter.

3. A charging device according to claim 1, wherein said sheet is a nonwoven fabric.

4. A charging device according to claim 1, wherein when said sheet is curled by moisture absorption, said sheet is convex toward a discharging wire provided to said corona charger.

5. A charging device comprising:

a corona charger configured to electrically charge a member-to-be-charged through an opening; and a sheet-like shutter configured to move along a longitudinal direction of said corona charger to open and close the opening, said sheet-like shutter having such a property that it is curled about an axis direction when said sheet-like shutter absorbs moisture, wherein the axis direction and the longitudinal direction of said corona charger form an angle therebetween from 45 degrees to 135 degrees.

6. The charging device according to claim 5, further comprising:

a winding up device configured to wind up said sheet-like shutter with respect to the longitudinal direction of said corona charger and urges said sheet-like shutter in the winding up direction of said sheet-like shutter.

7. The charging device according to claim 5, wherein said sheet-like shutter is a nonwoven fabric.

8. The charging device according to claim 5, wherein when said sheet-like shutter is curled by moisture absorption, a central portion of said sheet-like shutter is convex, more than end portions of said sheet-like shutter, toward a discharging wire provided to said corona charger with respect to the longitudinal of the corona charger.

* * * * *